US008834209B2

(12) United States Patent
Conrad

(10) Patent No.: US 8,834,209 B2
(45) Date of Patent: Sep. 16, 2014

(54) ELECTRICAL CORD AND APPARATUS USING SAME

(75) Inventor: Wayne Ernest Conrad, Hampton (CA)

(73) Assignee: G.B.D. Corp., Nassau (BS)

( * ) Notice: Subject to any disclaimer, the term of this patent is extended or adjusted under 35 U.S.C. 154(b) by 94 days.

(21) Appl. No.: 13/505,703

(22) PCT Filed: Nov. 4, 2010

(86) PCT No.: PCT/CA2010/001785

§ 371 (c)(1),
(2), (4) Date: May 29, 2012

(87) PCT Pub. No.: WO2011/054106

PCT Pub. Date: May 12, 2011

(65) Prior Publication Data

US 2012/0231654 A1 Sep. 13, 2012

(30) Foreign Application Priority Data

Nov. 6, 2009 (CA) ..... 2684820

(51) Int. Cl.

| | |
|---|---|
| ***H01R 13/64*** | (2006.01) |
| ***H01R 13/645*** | (2006.01) |
| *H01R 24/68* | (2011.01) |
| *H01R 24/22* | (2011.01) |
| *H01R 103/00* | (2006.01) |

(52) U.S. Cl.

CPC ..... *H01R 13/6456* (2013.01); *H01R 24/68* (2013.01); *H01R 24/22* (2013.01); *H01R 2103/00* (2013.01)

USPC ..... 439/680

(58) Field of Classification Search

USPC ..... 439/680, 488, 620.3, 502

See application file for complete search history.

(56) References Cited

U.S. PATENT DOCUMENTS

| | | | | | |
|---|---|---|---|---|---|
| 3,085,221 | A | | 4/1963 | Kelly | |
| 4,900,270 | A | * | 2/1990 | Edwards et al. | 439/502 |
| 5,254,019 | A | | 10/1993 | Noschese | |
| 5,466,172 | A | * | 11/1995 | Carstens et al. | 439/509 |
| 5,704,400 | A | * | 1/1998 | Eldridge | 138/96 T |
| 5,941,729 | A | * | 8/1999 | Sri-Jayantha | 439/505 |
| 6,080,022 | A | | 6/2000 | Shaberman et al. | |
| D466,867 | S | * | 12/2002 | Krobusek | D13/137.4 |
| 6,500,025 | B1 | * | 12/2002 | Moenkhaus et al. | 439/502 |
| 6,540,549 | B2 | * | 4/2003 | Rupert | 439/502 |
| 6,929,516 | B2 | | 8/2005 | Brochu et al. | |
| 6,962,506 | B1 | * | 11/2005 | Krobusek | 439/502 |

(Continued)

OTHER PUBLICATIONS

International Search Report received in connection to the corresponding international patent application No. PCT/CA2010/001785.

*Primary Examiner* — Briggitte R Hammond

(74) *Attorney, Agent, or Firm* — Philip C. Mendes da Costa; Bereskin & Parr LLP/S.E.N.C.R.L., s.r.l.

(57) ABSTRACT

An electricity conducting cord has first and second ends, one of the ends comprising an electrical connection member engageable with a power connection member of an apparatus having an apparatus power rating, at least one of the power connection member and the electrical connection member comprising electrical connectors and a physical cord identification member, the physical cord identification member is configured to inhibit the electricity conducting cord being electrically connected to the power connection member if the electricity conducting cord has a power rating lower than the apparatus power rating.

8 Claims, 8 Drawing Sheets

(56) References Cited

U.S. PATENT DOCUMENTS 6,976,885 B2 * 12/2005 Lord ..... 439/680
7,798,845 B1 * 9/2010 Buchanan ..... 439/502
2007/0077810 A1 4/2007 Gogel et al.
2008/0057780 A1 * 3/2008 O'Rourke ..... 439/505
2010/0197157 A1 * 8/2010 Wang ..... 439/275

* cited by examiner

ELECTRICAL CORD AND APPARATUS USING SAME

FIELD

This invention relates to power cords, also referred to as electricity conducting cords, such as those that may be used with household appliances and a household appliance that is operated with a power cord.

INTRODUCTION

Household appliances such as surface cleaning apparatus (e.g. a vacuum cleaner, carpet extractor and the like), power tools, kitchen appliances, personal care products (e.g. hair driers, electric toothbrushes and the like) and lawn or garden tools typically are operated using household electric current. Accordingly, each appliance is sold with a power cord. Typically, the power cord is non-removably affixed to the appliance. When the appliance reaches the end of its life, the power cord is thrown away with the rest of the appliance. Typically, the appliance is disposed of (e.g., sent to landfill) as it has reached the end of its life as opposed to the electrical cord requiring replacement. Further, a significant percentage of small appliances are destroyed in the field by retailers when returned by customers as opposed to being sent back to the manufacturer or marketer for refurbishment.

It is known to provide some electronic devises, such as computers and electric kettles, with a removable power cord. However, a specific power cord may be designed for each appliance. Accordingly, while the power cord may be kept when the appliance is disposed of, the power cord may not be designed to mate with a replacement appliance (i.e. the plug of the power cord may not fit into a socket of the replacement appliance).

Extension cords for household use are commonly available. Extension cords typically have a standard single plug for insertion into a household electrical socket and one or more sockets into which the standard plug of an appliance may be inserted. Accordingly, the extension cords are generic and may be used with any appliance. For example, an appliance plug with a three-prong connector may be inserted into any extension cord having a three-prong socket. Similarly, an appliance having a two-prong connector may be inserted into any extension cord having two mating recesses for the prongs.

SUMMARY

In accordance with this invention, a reusable electricity conducting cord is provided. The electricity conducting cord is designed so that it may not be utilized with an appliance having a higher power rating (e.g. amperage rating) then that of the electricity conducting cord. Accordingly, either the appliance or the electricity conducting cord, and preferably both, are provided with a cord identification member. The cord identification member inhibits a cord from being plugged into an appliance if the cord is underrated for the appliance. Accordingly, one advantage of this design is that reusable cords may be provided. For example, a series of cords having various power ratings may be provided. These cords may be kept by a consumer and utilized with an appliance having a compatible (the same or lower) power rating. Therefore, when an appliance is disposed of, the electricity conducting cord may be kept and re-used for an appliance having a compatible power rating.

In an optional embodiment, a series of electricity conducting cords having different power ratings may be available (e.g., provided with a product or sold separately). The electricity conducting cords may have different cord identification members based on the power rating of the electricity conducting cord. The cord identification member inhibits an electricity conducting cord being electrically connected to an appliance and/or another electricity conducting cord, if the electricity conducting cord has a power rating that is lower than the power rating of the appliance.

For example, an appliance may be sold by itself and the manufacturer or a third party may provide a series of electricity conducting cords, which may be sold separately or supplied with an appliance. Accordingly, if a user already has an electricity conducting cord, it is not necessary for the manufacturer to supply an electricity conducting cord with the appliance. The consumer may use an electricity conducting cord that the consumer already has. Alternately, if the consumer does not have a suitable electricity conducting cord, they may purchase one separately. Electricity conducting cords use a relatively large amount of copper. By providing a re-usable electricity conducting cord, the amount of copper which is utilized in the manufacture of an appliance, and which is eventually disposed of at the end of life of the appliance is reduced. By permitting the user to keep the electricity conducting cord, the amount of copper that is utilized is therefore reduced. Further, by providing the cord identification member, a user may not use an underrated cord on an appliance.

In another mode of operation, a user may have a number of the identical electricity conducting cords (i.e. an electricity conducting cord with the same electrical rating). The user may therefore keep the electricity conducting cord in various locations. When the appliance is to be used, the user need not move the electricity conducting cord with the appliance. Instead, the appliance may be moved to the required location and the electricity conducting cord at that location may be utilized. For example, a vacuum cleaner may be provided with an electricity conducting cord of about 25 feet. The electricity conducting cord may represent a significant amount of weight of the vacuum cleaner, particularly if the vacuum cleaner is a stick type vacuum cleaner. This added weight may increase the difficulty for an elderly or disabled person to carry the vacuum cleaner to another location. Accordingly, a consumer may have a first electricity conducting cord in one room or a first floor of a house and the same power rated electricity conducting cord in another room or another floor of the house. Accordingly, when the vacuum cleaner is moved to the second location, an electricity conducting cord is available for use and the consumer has not had to carry the additional weight of the electricity conducting cord. Further, the vacuum cleaner may be easier to store without the cord attached.

It will be appreciated that the power rating of an electricity conducting cord is based upon the amount of electricity that the cord can provide. This will be based, inter alia, upon the gauge of the wire as well as the length of the cord.

Accordingly, in accordance with a first embodiment of the invention, there is provided an appliance having an appliance power rating the appliance comprising (a) an electrically operated member;

(b) an electrical connection member; and, (c) an electricity conducting cord having a first end connectable in electric communication with the electrical connection member and a second end connectable with a source of electricity wherein at least one of the electrical connection member and the first end of the electricity conducting cord have at least one cord identification member configured and/or to prevent the first end of an electricity conducting cord having a power rating lower than the appliance power rating being electrically connected to the electrical connection member.

In some embodiments, the electrical connection member may have a first cord identification member and the first end of the electricity conducting cord may have a second cord identification member. Preferably, one of the first and second cord identification members comprises a male member and the other of the first and second cord identification members comprises a female member. Preferably, the male member and the female member are sized, positioned and/or shaped, and/or the number of male members that are provided on the end having the male members, is based on the power rating of the respective part on which the male member and the female member is provided.

In some embodiments, the appliance may further comprise a plurality of electricity conducting cords of varying gauges and the male member provided on the end having the male member may increase in size as the gauge of the electricity conducting cord increases.

In some embodiments, the appliance may further comprise a plurality of electricity conducting cords of varying gauges and the female member provided on the end having the female member may decrease in size as the gauge of the electricity conducting cord increases.

In some embodiments, the first and second cord identification members may be inter-engageable only if the electricity conducting cord has a power rating the same as or higher than the appliance power rating.

In some embodiments, one of the first and second cord identification members may be a male engagement member and the other of the first and second cord identification members may be a female engagement member and the male engagement member may be positioned and configured to be engageable with a female engagement member only if the electricity conducting cord has a power rating the same as or higher than the appliance power rating.

In some embodiments, the appliance may have an appliance electric cord having a length of up to one foot. Preferably, the appliance electric cord has a length of up to 6 inches.

In some embodiments, the electricity conducting cord may have a length of at least 6 feet, preferably 6-300 feet and more preferably 25-50 feet.

In some embodiments, the cord identification member of the electrical connection member may be positioned or configured based on the power rating of the appliance and the cord identification member of the electricity conducting cord may have a power rating based on the length and gauge of the electricity conducting cord.

In some embodiments, the cord identification member of the electricity conducting cord may be positioned or configured based on the length and gauge of the electricity conducting cord.

In some embodiments, the electrical connection member may be a plug and the first end of an electricity conducting cord may be a socket.

In some embodiments, the electrical connection member may be a socket and the first end of an electricity conducting cord may be a plug.

In some embodiments, at least one of the electricity conducting cord and the electrical connection member may include a fuse. Preferably, the fuse is provided in at least one of the electrical connection member and the first end of the electricity conducting cord. More preferably, the appliance further comprises a visual signaling member indicative of the fuse being in operating condition or an audio signaling member indicative of the fuse being blown.

In some embodiments, the appliance may further comprise a visual signaling member indicative of the amount of power flowing through the electricity conducting cord. Preferably, the visual signaling member comprises at least one of a plurality of different coloured lights, a light having a variable colour, a light having a variable intensity or a meter.

In some embodiments, the fuse may comprise a fuse link member, the fuse link member is visible when the fuse is installed and the visual signaling member comprises the fuse link member.

In some embodiments, the fuse may be resettable and the position of a fuse reset member comprises the visual signaling member.

In some embodiments, the visual signaling member may comprise an illumination member that is illuminated when current flows through the electricity conducting cord.

In some embodiments, the appliance may further comprise an illumination member that is illuminated when current flows through the electricity conducting cord.

In some embodiments, the appliance may be selected from the group consisting of a surface cleaning apparatus, a power tool, a kitchen appliance, a kitchen appliance, a lawn or garden appliance and a personal care product.

In accordance with another embodiment of the invention, there is provided an electricity conducting cord having first and second ends, one of the ends comprising an electrical connection member engageable with a power connection member of an apparatus having an apparatus power rating, at least one of the power connection member and the electrical connection member comprising electrical connectors and a physical cord identification member, the physical cord identification member configured to inhibit the electricity conducting cord being electrically connected to the power connection member if the electricity conducting cord has a power rating lower than the apparatus power rating.

In accordance with another embodiment of the invention, there is provided an apparatus comprising an electrically powered unit having a first electrical connection member, the first electrical connection member comprising electrical connectors and a physical identifying member, the physical identifying member configured to permit a second electrical connection member to only engage the first electrical connection member if the second electrical connection member has a power rating compatible with the apparatus.

The electricity conducting cord and the apparatus may use any one or more of the features of the alternate embodiments of the appliance.

DRAWINGS

These and other advantages will be more fully and clearly understood in connection with the following description of the preferred embodiments, which are shown in the following drawings.

DESCRIPTION OF VARIOUS EMBODIMENTS

Various apparatuses or methods will be described below to provide an example of each claimed invention. No example described below limits any claimed invention and any claimed invention may cover processes or apparatuses that are not described below. The claimed inventions are not limited to apparatuses or processes having all the features of any one apparatus or process described below or to features common to multiple or all of the apparatuses described below. It is possible that an apparatus or process described below is not an embodiment of any claimed invention.

Figure 5:
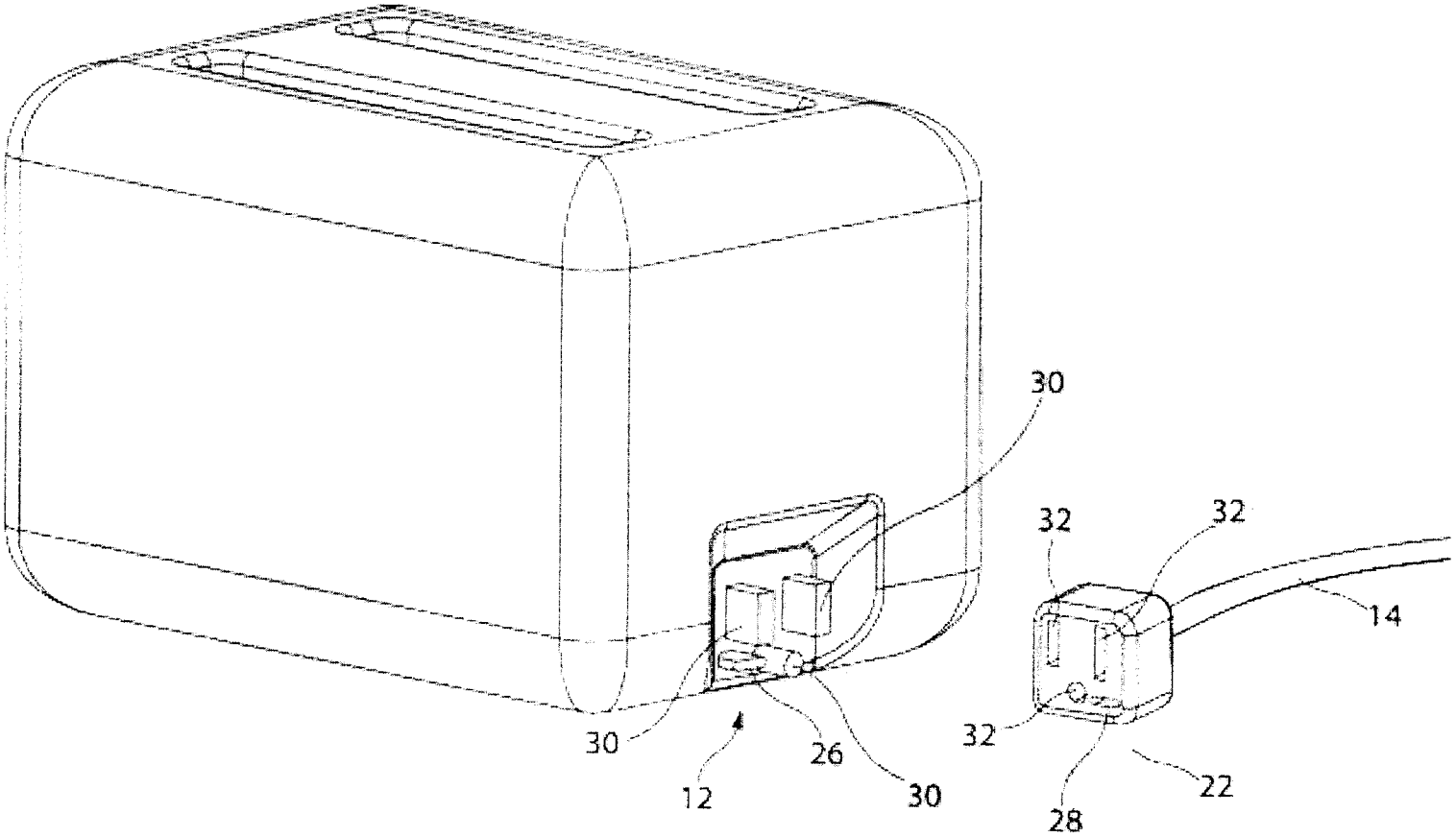
FIG. 5 is a perspective view of another appliance in accordance with an embodiment of this invention.

In accordance with this invention, an electrically operated appliance 10 is utilized. The appliance, or apparatus, may be any apparatus, which requires an electricity conducting cord. Preferably, the appliance may be a vacuum cleaner or other surface cleaning apparatus (e.g. an extractor, carpet cleaner etc.), a power tool (such as a drill, skill saw, sander or the like), a kitchen appliance (such as an electric kettle, a toaster, a juicer or the like), a lawn or garden appliance (such as a lawn mower, hedge trimmers, or the like), or a personal care product (such as a hair dryer, electric tooth brush or the like). For example, as exemplified in FIGS. 1-4, appliance 10 is a vacuum cleaner. As exemplified in FIG. 5, appliance 10 is a toaster. Each appliance has an electrically operated member. For example, in the case of a vacuum cleaner, the electrically operated member may be the suction motor, and, optionally, a light, a brush motor or the like. In the case of a toaster, the electrically operated member may be the heating elements provided in the toaster. Accordingly, the electrically operated member may be a member having a moving part or no moving part.

As exemplified in FIGS. 1-5, appliance 10 is provided with an electrical connection member 12. Electrical connection member may be provided in the housing of appliance 10 itself (as exemplified in FIGS. 1-4) or may be provided at the end of a short electricity conducting cord, e.g. a pigtail cord, as exemplified in FIG. 5. The pigtail cord may have a length of up to one foot and, preferably, up to only about six inches. If such a cord is provided, it may have an advantage of facilitating a user plugging an electricity conducting cord 14, 16, 18, 20, into first electrical connection member 12.

First electrical connection member 12 is a plug which may be recessed in a housing of appliance 10. In particular, a shown in FIG. 5, first electrical connection number 12 has three electrical connectors, one of which is a ground, and a first cord identification member 26. In an alternate embodiment, it will be appreciated that electrical connection member 12 may only have two electrical connectors (i.e., a ground may not be required). In an alternate embodiment, it will be appreciated that electrical connection member 12 may be a socket as opposed to a plug. Further, the electrical connection member may be provided at any location that is desired on the appliance.

As shown in FIGS. 1-3 and 5, one or more electrical connection members 12, 14, 16 and 18 may be provided with appliance 10 or usable with appliance 10. For example, referring to FIG. 1, appliance 10 may be provided with two electricity conducting cords 14 and 16. Cords 14 and 16 may be of varying lengths. Each cord is provided with a first end 22, which is insertable or mate able with first electrical connection member 12. Accordingly, as exemplified in FIG. 5, first end 22 is a socket having a plurality of recesses 32 sized to receive electrical connectors 30. It will be appreciated that in an alternate embodiment, first electrical connection member 12 may be a socket and first end 22 may be a plug.

It will be appreciated that, in order to provide a required power level to appliance 10, the electricity conducting cord should be approved (e.g. by UL) to supply that particular level of power. Therefore, the gauge of the wire that is utilized for the electricity conducting cord may vary depending upon several factors including the gauge of the wire and the length of the wire. For example, if a longer wire is utilized, then to supply the same power requirement, a heavier gauge (larger gauge) wire is utilized. For example, while a 16 gauge wire may be rated for 10 amps, if a longer electricity conducting cord is utilized, then an 18 gauge wire (which is typically rated 8 amps) may be required.

Figure 1:
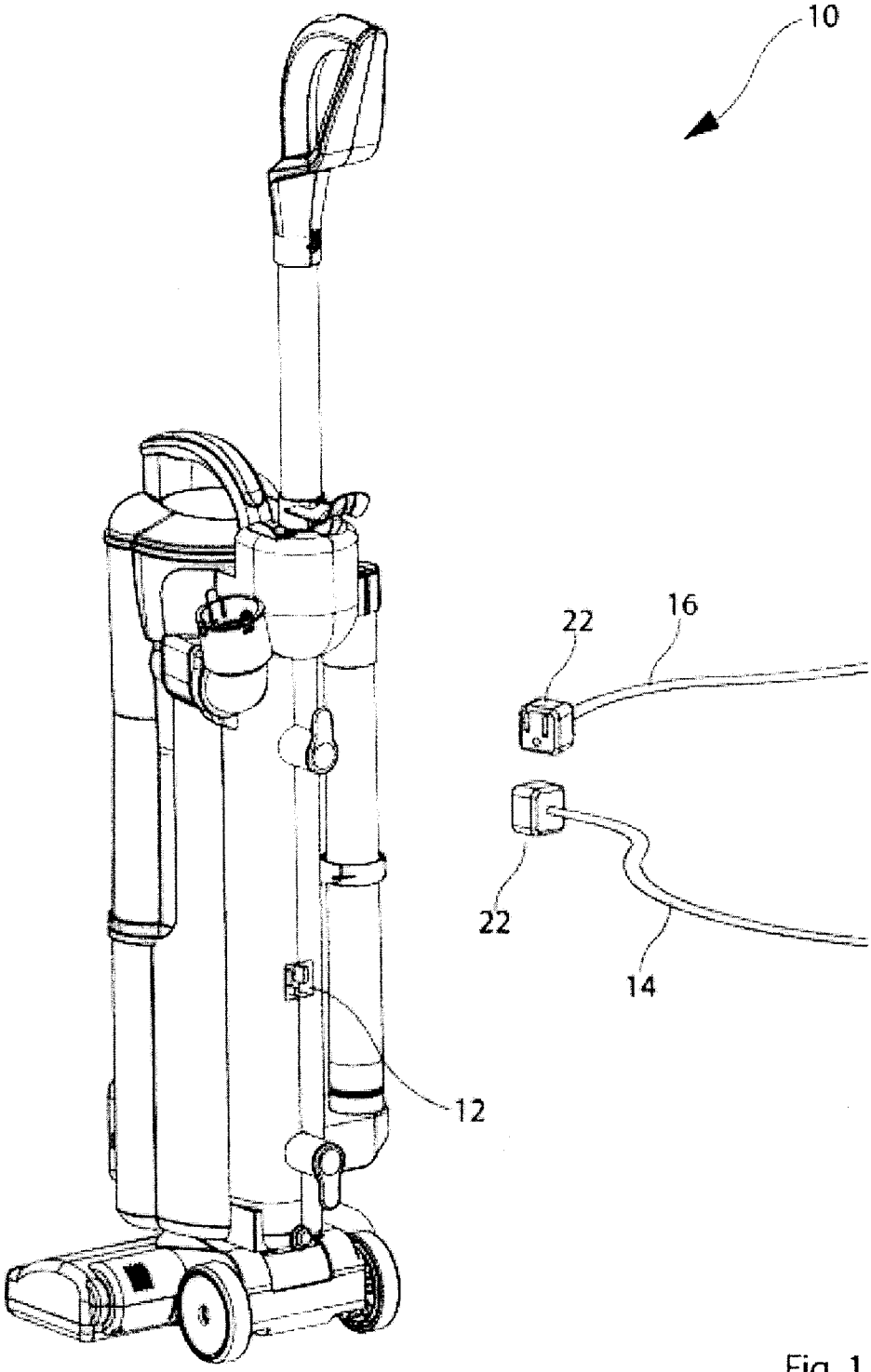
FIG. 1 is a perspective view of an appliance according to one embodiment of this invention.
Figure 2:
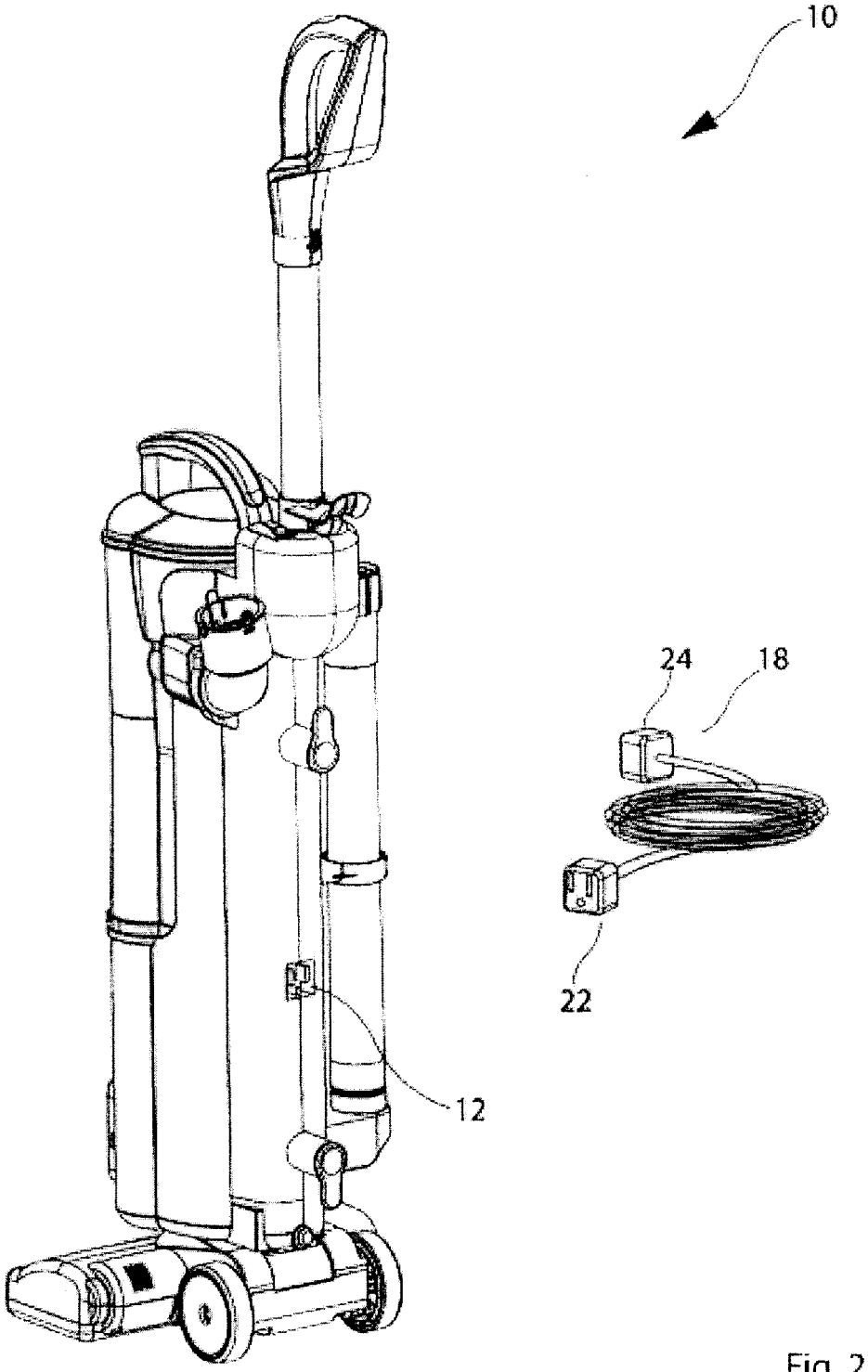
FIG. 2 is a perspective view of the appliance of FIG. 1 in accordance with another embodiment of this invention.
Figure 3:
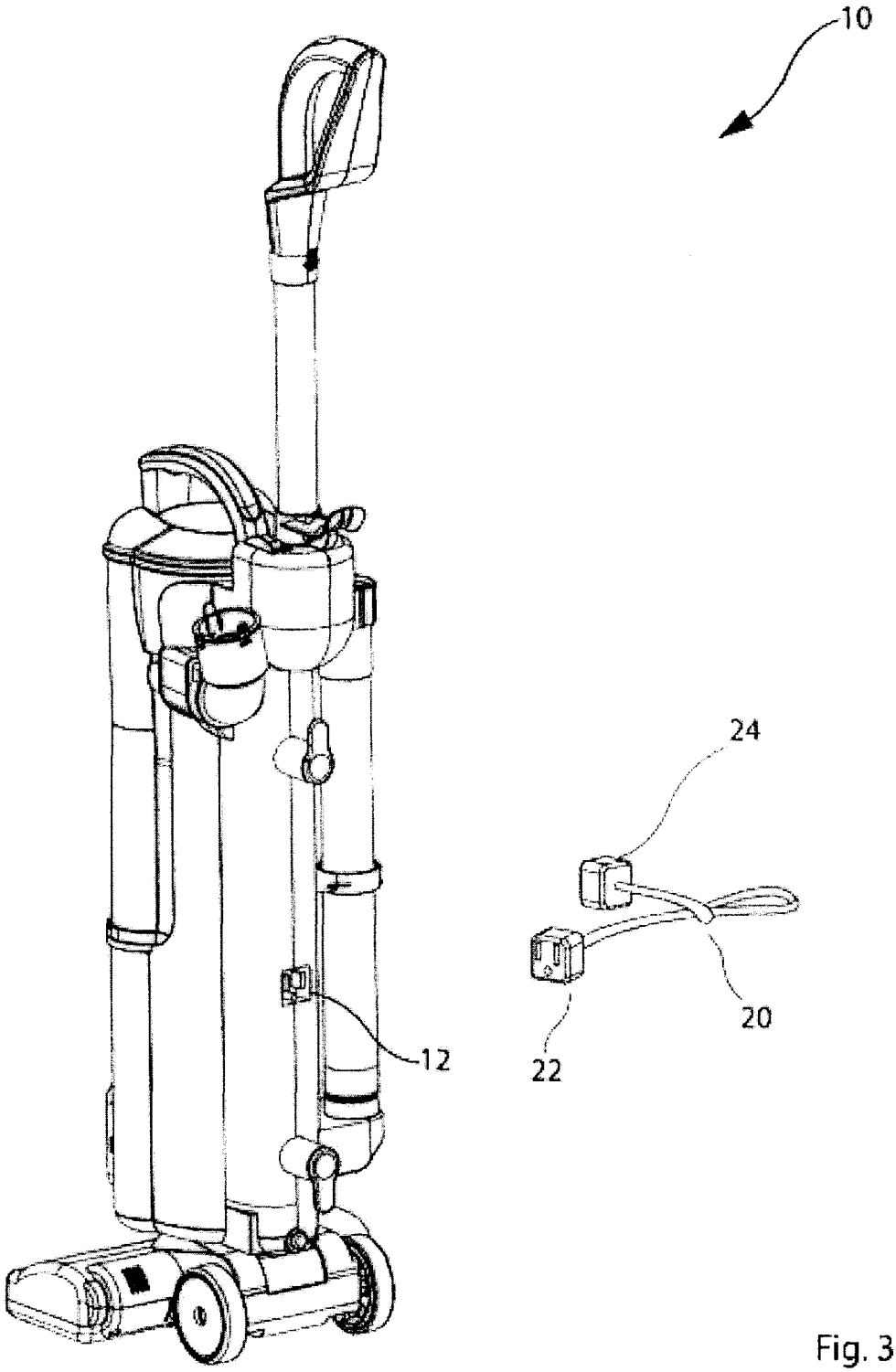
FIG. 3 is a perspective view of the appliance of FIG. 1 in accordance with a further embodiment of this invention.
Figure 4:
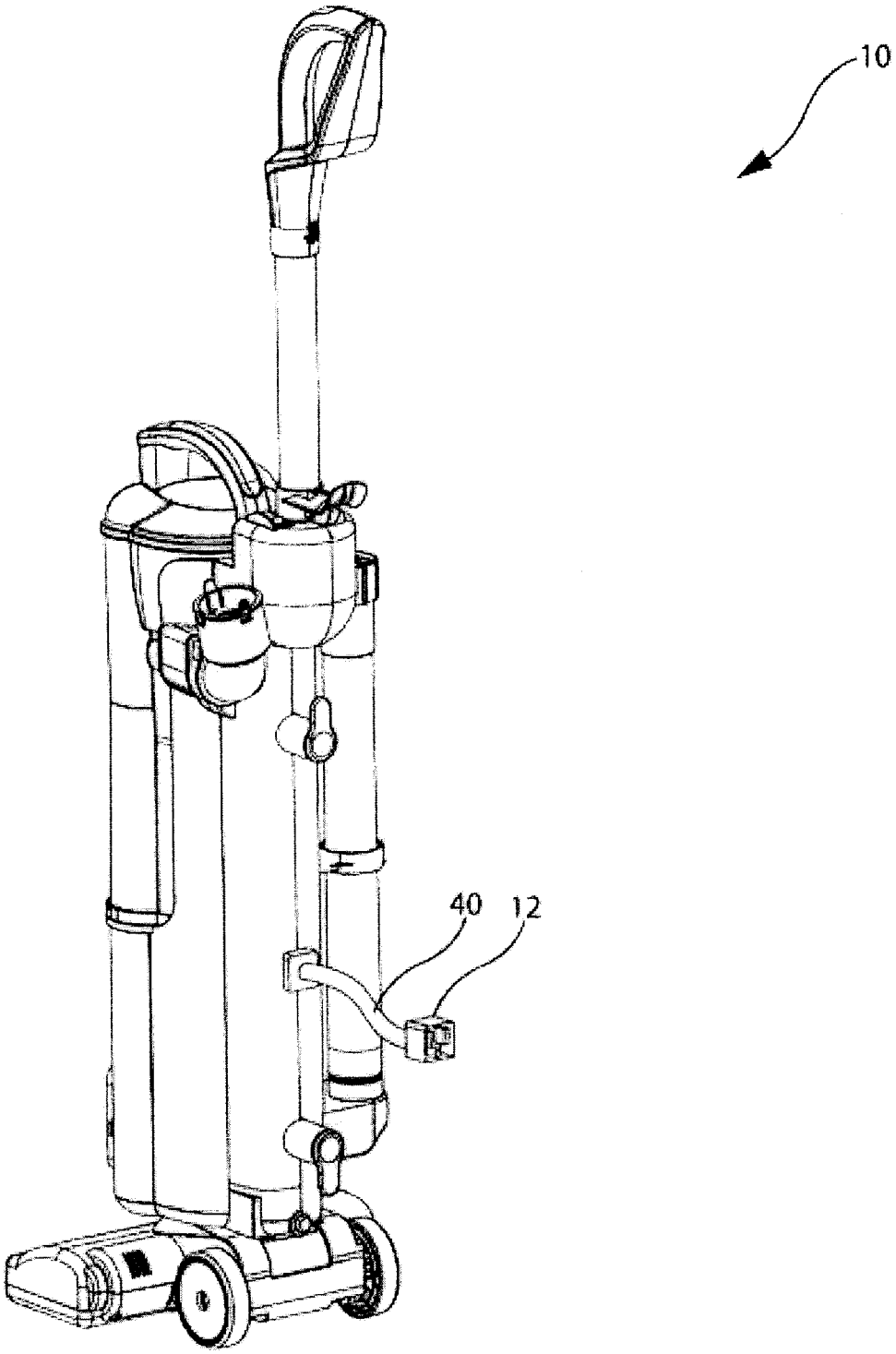
FIG. 4 is a perspective view of the appliance of FIG. 1 in accordance with a further embodiment of this invention.

As exemplified in FIG. 2, appliance 10 is provided with or is usable with an electricity conducting cord 18, which is a relatively long cord. For example, the cord may be at least 6 feet long, optionally from 6 to 300 feet long, and preferably from 25 to 50 feet long. Accordingly, due to the length of the cord, a heavier gauge wire may be utilized to provide the requisite power to appliance 10. As shown in FIG. 3, appliance 10 is usable with an electricity conducting cord 20. Electricity conducting cord 20 is shorter and may accordingly be of a lighter gauge wire and still be rated to supply the power requirements of appliance 10.

As shown in FIGS. 2 and 3, electricity conducting cord 18, 20 has a second end 24. Second end 24 is preferably configured to plug into, for example, a household electrical outlet. Accordingly, second end 24 may be a standard plug (e.g. a two prong or a three prong plug depending whether the electricity conducting cord includes a ground pin). It will be appreciated that the configuration of first and second ends 22 and 24 may vary depending upon the standard prong configuration that is utilized in different countries.

The cord identification member is configured and/or positioned to prevent first end 22 of an electricity conducting cord having a power rating lower than the power rating of appliance 10 being electrically connected to first electrical connection member 12. In a preferred embodiment, it is preferred that each of electrical connection member 12 and first end 22 are provided with a cord identification member. Accordingly, as exemplified in FIG. 5, electrical connection member 12 is provided with a first cord identification member 26 and first end 22 is provided with a second cord identification member 28. First and second cord identification members 26, 28 are configured and/or positioned to permit first end 22 to be plugged into electrical connection member 12 if electricity conducting cord 14 has a power rating that is the same as or higher than that of appliance 10 and will prevent first end 22 plugging into electrical connection member 12 if electricity conducting cord 14 has a power rating lower than the power rating of appliance 10. Therefore, by varying, for example, one or more of the size, shape and position of one or both of the cord identification members 26, 28, a plurality of different first ends 22 and first electrical connection members 12 may be provided.

It will be appreciated that a cord which has a UL approval for a particular power rating (e.g. a 10 amp rating) may be used to supply power to an appliance having a power rating of 10 amps. Further, the same cord may be used to supply power to an appliance having a lower power rating (e.g. 8 amps or even 6 amps). However, the same cord should not be used to provide power to an appliance having a higher power rating (e.g. 14 amps). In such a case, the electricity passing through the electricity conducting cord may result in the cord, for example, overheating and failing. Accordingly, in one embodiment, the cord identification members may be configured to permit only an electricity conducting cord having the power rating identical to the power rating appliance being connected to the appliance. More preferably, the cord identification member or members are configured such that only electricity conducting cords having a power rating having the same as or higher than the power rating of the appliance may be connected to the appliance.

Figure 6:
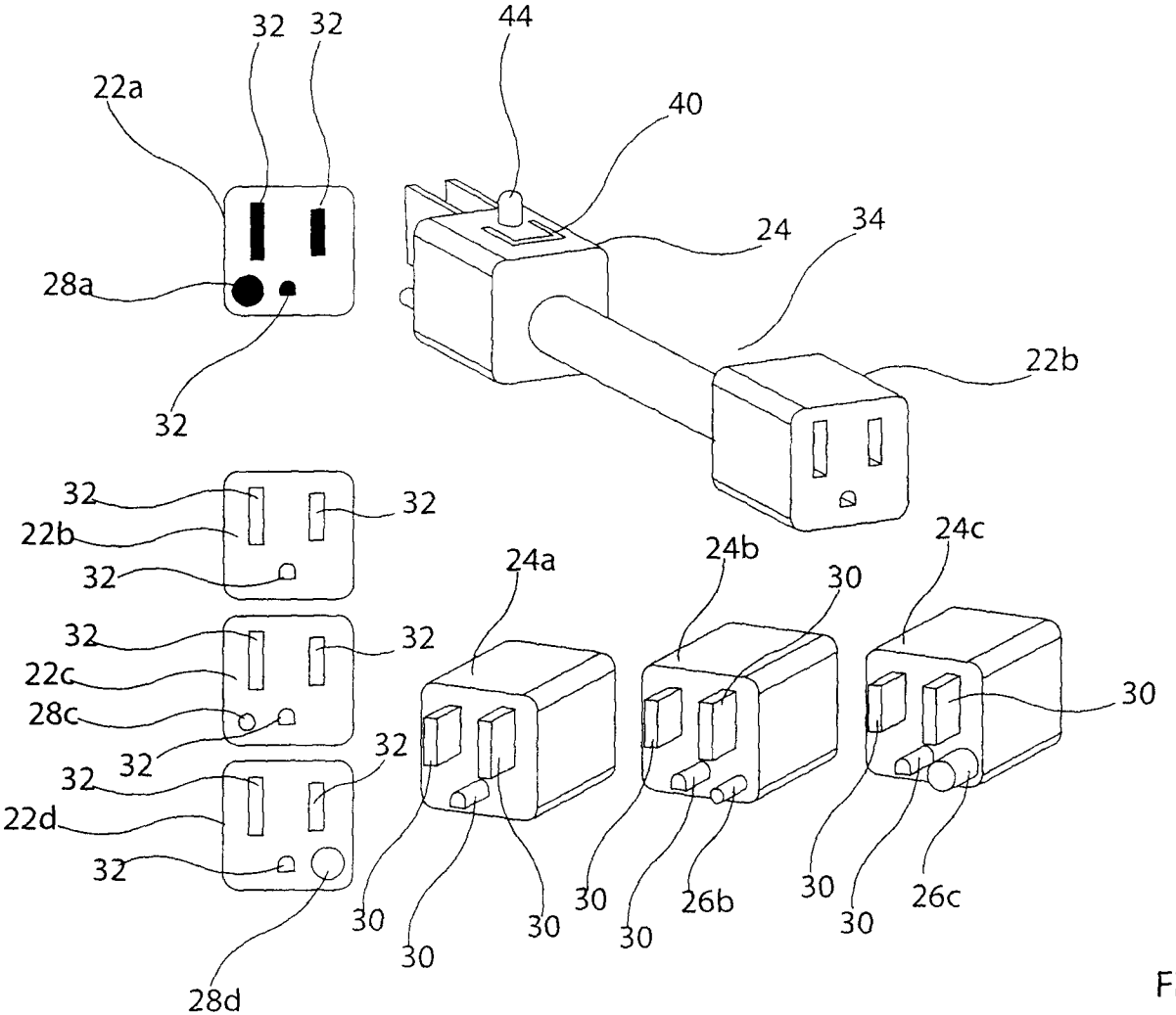
FIG. 6 is a perspective view of an electricity conducting cord according to one embodiment of this invention showing a plurality of optional sockets and a plurality of optional plugs that may be utilized.

In accordance with another embodiment, the electricity conducting member may be an extension cord. An example of such an embodiment is shown in FIG. 6. As shown therein, electricity conducting cord 34 is a heavy gauge ground wire having a first end comprising a socket 22 and a second end 24 comprising a plug. FIG. 6 exemplifies a plurality of possible first ends 22*a*, 22*b*, 22*c* and 22*d* and a plurality of possible second ends 24*a*, 24*b* and 24*c*. In each of these embodiments, the first cord identification member 26 is a male member and is exemplified as a protrusion having a constant diameter. It will be appreciated that the diameter may vary. In each of these embodiments, the second cord identification member 28 is a female member and is exemplified as a recess or opening having a constant diameter. It will be appreciated that the diameter may vary. In particular, first end 22*a* has a large round recess 28*a* to the bottom left for receiving a cord identification member 26. First end 22*b* is not provided with a cord identification member. First end 22*c* is provided with a small round recess 28*c* provided in the lower right hand corner. First end 22*d* is provided with a larger round recess 28*d* in the lower right hand corner. Similarly, second end 24*a* is not provided with a cord identification member. Second end 24*b* is provided with a small round protrusion 26*b* in the lower right hand corner and first end 24*c* is provided with a larger round protrusion 26*c* in the lower right hand corner.

It will be understood that the different configurations for first end 24 may be utilized as first electrical connection member 12 provided on appliance 10. Accordingly, proceeding on that basis, an exemplary method of using these differently shaped recesses and protrusions will now be described. Electrical connection member 12 may be configured the same as second end 24*c*. In such a case, a large round first cord identification member 26*c* is provided. In this case, only a cord having a recess 28 which is of at least the same diameter, if not larger, than first cord identification member 26*c* will permit a first end 22 to be inserted into first connection member 12. Accordingly, for example, appliance 10 may have a power rating of 15 amps. If electricity conducting cord 34 is provided with first end 22*a*, then electricity conducting cord 34 may be plugged into the appliance to provide power to the appliance. Accordingly, electricity conducting cord 34 is designed with a power rating of at least 15 amps.

In an alternate example, appliance 10 may be provided with a first electrical connection member 12, which is configured the same as second end 24*b*. In such a case, the appliance may have a lower power rating (e.g. 8 amps). In such a case, an electricity conducting cord 34 having a first end 22*a* and a power rating of, e.g. 15 amps, may be plugged into the appliance. In such a case, the cord is over rated but usable. Alternately, a cord having a lower power rating (e.g. 8 amps) may be provided with a first end 22*c*. Second cord identification member 28*c* is positioned and configured to receive first cord identification member 26*b*. Accordingly, first end 22 may be plugged into appliance 10 to supply power to appliance 10.

In another embodiment, an appliance may be provided with a first electrical connection member 12 configured the same as first end 24*a*. In such a case, no cord identification member is provided. In this example, appliance 10 may have the highest power rating for a series of electricity conducting cords. Accordingly, only a cord with no cord identification member on first end 22 may be inserted into the appliance (e.g. a cord with first end 22*b*). Any electricity conducting cord with a cord identification member (e.g. a protrusion 26) would not be able to plug into the appliance. Accordingly, if a series of electricity conducting cords are provided, then no cord identification member may be provided on the highest rated cord since it may be used with any appliance in the series.

In an alternate embodiment, it will be appreciated that a cord 34 may be provided with a first end 22*d*. In this case, first end 22*d* has a recess 28*d* which is of the same size as first cord identification member 26*c*. However, recess 28*d* is located in a different location (the bottom right corner as opposed to the bottom left corner). Accordingly, a first end 22*d* could not be plugged into appliance 10. Accordingly, it will be appreciated that a change in position may be used to prevent a lower rated cord being electrically connected to an appliance 10.

Figure 7:
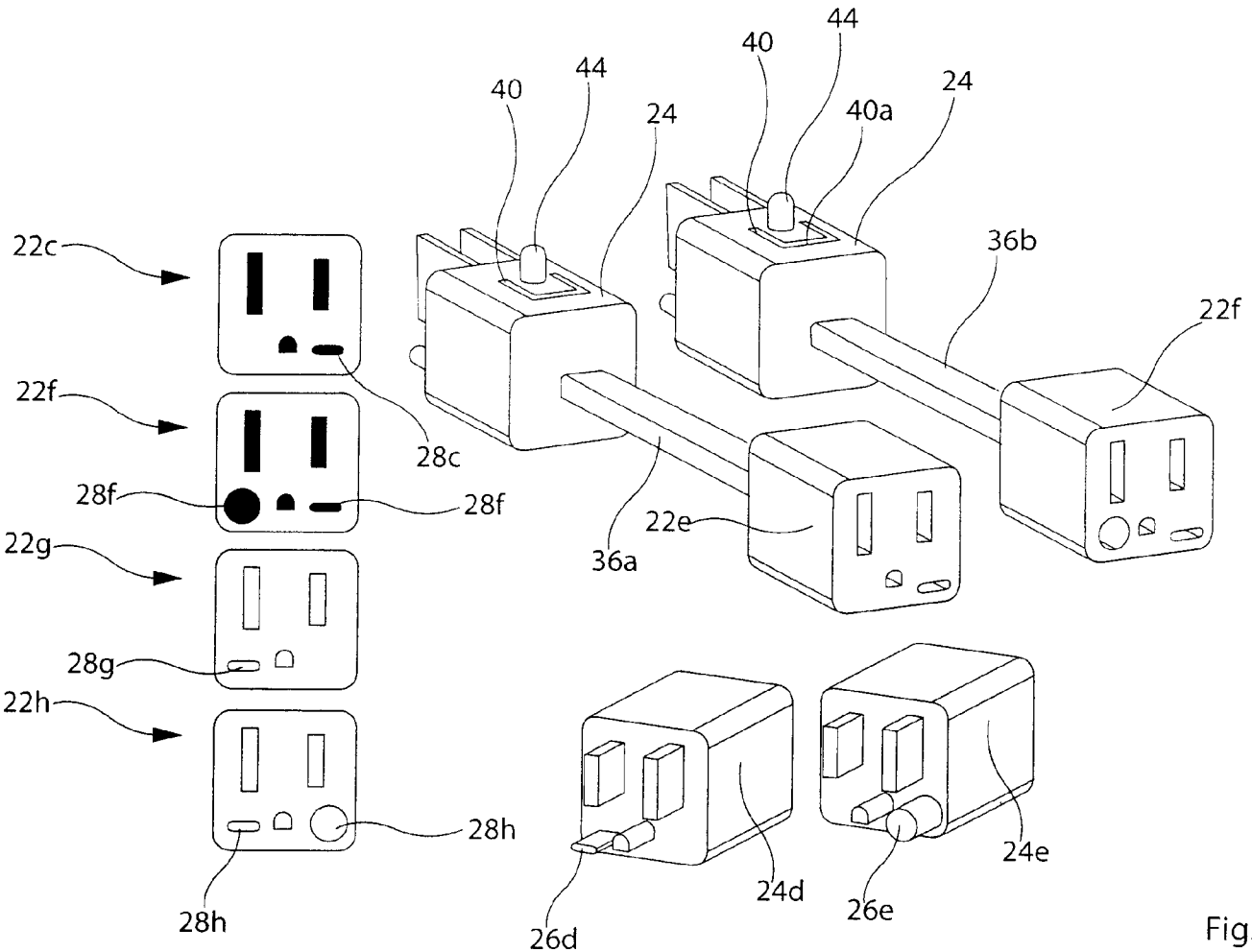
FIG. 7 is a perspective view of two electricity conducting cords according to another embodiment of this invention showing alternate sockets and alternate plugs that may be utilized; and, FIG. 8 is a perspective view of a further electricity conducting cord according to another embodiment of this invention showing an alternate series of sockets and plugs that may be utilized.
Figure 8:
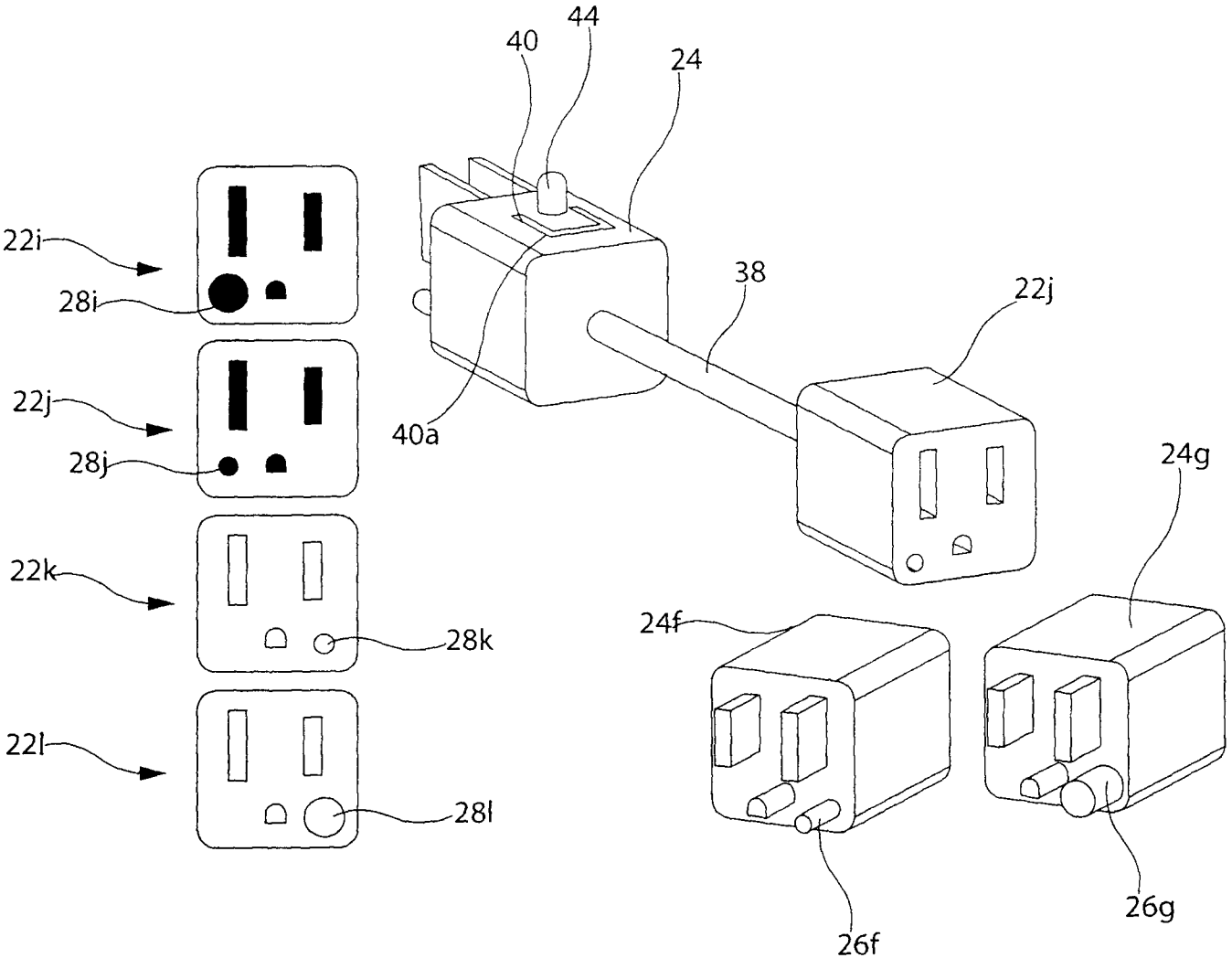

FIGS. 7 and 8 exemplify additional alternate embodiments. FIG. 7 exemplifies two electricity conducting cords 36*a* and 36*b*, which have a square or oval electricity conducting cord. FIG. 8 exemplifies an electricity conducting cord 38 having a lower gauge round wire. A plurality of different configurations for first end 22 and second end 24 are provided. These exemplify different options for the position, configuration and number of cord identification members, which may be provided. As will be appreciated from first ends 22*a*-22*l* and second ends 24*a*-24*g*, a large variety of different combinations of position and configurations of the cord identification members 26, 28 may be provided. Further, these figures exemplify the use of cord identification members having a different cross-sectional shape.

In one embodiment, the electricity conducting member may be designed to plug into a household electrical outlet. Accordingly, second end 24 may be a standard electrical plug. In an alternate embodiment, electricity conducting member, such as electricity conducting members 34, 36*a*, 36*b* and 38 may be designed as extension cords to be connected to an appliance or another electricity conducting cord 12, 14, 16, 18, 20. In such a case, the cords may be designed so that two electricity conducting cords may only be electrically connected together if they have compatible power ratings.

In accordance with another embodiment, a fuse 40 may be provided as part of the electrical circuit. The purpose of the fuse is to prevent an underrated cord being mistakenly used if, for example, one of the cord identification members is damaged (e.g. protrusion 26 is broken off). If an underrated cord is mistakenly used, then the fuse will preferably blow to open the electrical circuit and prevent electricity flowing through the underrated cord to the appliance. Preferably, the fuse is provided in at lease one of electrical connection member 12 and first end 22 of the electricity conducting cord. Preferably, the fuse is located in the electricity conducting cord, such as first end 22 or second end 24 (as exemplified in FIGS. 6-8).

Preferably, the fuse 40 provides a visual signal to a user that the cord is operational. For example, the fuse 40 may have a fuse link member 40*a*, which is designed to break if too much electricity flows through the cord. The fuse link member may accordingly be visible (positioned such that it may be seen when inserted into e.g. first or second ends 22, 24). Accordingly, when the fuse link member breaks, it provides a visual signal to a user that the cord is no longer operational. Alternately, the fuse may be re-settable (e.g. a circuit breaker or a GFI). In such a case, the position of the fuse reset member may provide a visual signaling member advising a user that the cord is no longer operational.

It will also be appreciated that the visual signaling member may be a light, e.g. LED 44 that illuminates when electricity flows through the cord. For example, it may a light as is used in a GFI. Accordingly, the visual signaling member may comprise an illumination member that is illuminated when current flows through the electricity conducting cord and/or when power is supplied to a cord or appliance having the light.

It will also be appreciated that the visual signaling member may advise a user of the amount of power which is flowing through a cord or to an appliance 10. For example, the cord may be provided with a series of lights, which may be differently coloured. The number of lights, which are illuminated, and/or the colour that is emitted, could be indicative of the amount of power, which is flowing through the cord. Alternately, or in addition, the intensity of a light may vary as the power flowing through a cord varies. Alternately, or in addition, the cord may be provided with a meter, which indicates the amount of electricity flowing through the cord. For example, the meter could be an analog meter or a digital meter (e.g. an LCD screen with a plurality of bars which are illuminated as more power flows through the cord).

All of the forgoing are examples of the visual signaling member that is indicative of a cord being in operating condition. It will be appreciated that in addition thereto or in lieu thereof, an audio signaling member may be provided, which preferably advises a user if a power is not supplied to an appliance 10. Preferably, the audio signaling member emits a sound if the fuse is blown and requires replacement.

It will be appreciated that the cord identification members may accordingly be used with an electricity conducting member 14, 16, 18, 20, which is intended to be plugged into a standard household electrical outlet. In such a case, first end 22 of the electricity conducting cord may be provided with a first cord identification member. The second end 24 of the cord need not be provided with a second cord identification member.

In another embodiment as exemplified in FIGS. 6-8 an electricity conducting cord 34, 36*a*, 36*b*, 38 is provided with first and second ends 22, 24 each of which utilize a cord identification member. Accordingly, the electricity conducting cord may be utilized with an extension cord. For example, first end 22 of the electricity conducting cord 34, 36*a*, 36*b* and 38 may have cord identification member and may be usable with an appliance 10 (i.e., electrically contactable to first electrical connection member 12). The second end 24 is a second electrical connection member and is provided with a cord identification member, which controls the extension cord that may be plugged into second end 24. Accordingly, a further extension cord having a second end 24 comprising a standard plug may be plugged into the second end of the cord that is plugged into appliance 10.

It will be appreciated that an appliance or an electricity conducting cord may utilize one or more of the features disclosed herein. Further, what has been described above has been intended to be illustrative of the invention and not limiting and it will be understood by a person skilled in the art that other variants and modifications may be made without departing from the scope of the invention as defined in the claims appended hereto.

The invention claimed is:

1. An appliance having an appliance power rating the appliance comprising (a) an electrically operated member;

(b) an electrical connection member having a first face; and, (c) an electricity conducting cord selectable from a plurality of available electricity conducting cords of varying gauges, the electricity conducting cord having a first end connectable in electric communication with the electrical connection member and a second end connectable with a source of electricity, the first end having a second face wherein one of the first and second faces is provided with male electrical connection members and the other of the first and second faces is provided with mating female electrical connection members wherein the electrical connection member has a first cord identification member and the first end of the electricity conducting cord has a second cord identification member, one of the first and second cord identification members comprises a male cord identification member and the other of the first and second cord identification members comprises a female cord identification member and (i) the male cord identification member increases in size as the gauge of the electricity conducting cord increases, or (ii) the female cord identification member decreases in size as the gauge of the electricity conducting cord increases.

2. The appliance of claim 1 wherein the first and second cord identification members are inter-engageable only if the electricity conducting cord has a power rating the same as or higher than the appliance power rating.

3. The appliance of claim 1 wherein the cord identification member of the electricity conducting cord is positioned or configured based on the length and gauge of the electricity conducting cord.

4. The appliance of claim 1 wherein the electrical connection member is a plug and the first end of an electricity conducting cord is a socket.

5. The appliance of claim 1 wherein the electrical connection member is a socket and the first end of an electricity conducting cord is a plug.

6. The appliance of claim 1 wherein at least one of the electricity conducting cord and the electrical connection member includes a fuse.

7. An electricity conducting cord selectable from a plurality of available electricity conducting cords of varying gauges, the electricity conducting cord having first and second ends, one of the ends comprising an electrical connection member engageable with a power connection member of an apparatus having an apparatus power rating, the electrical connection member comprising a face having electrical connectors engageable with mating electrical connectors provided on the power connection member and also having a first physical cord identification member engageable with a second physical cord identification member provided on the power connection member, wherein the electrical connection member has a first cord identification member and the first end of the electricity conducting cord has a second cord identification member, one of the first and second cord identification members comprises a male cord identification member and the other of the first and second cord identification members comprises a female cord identification member and (i) the male cord identification member increases in size as the gauge of the electricity conducting cord increases, or (ii) the female cord identification member decreases in size as the gauge of the electricity conducting cord increases.

8. The electricity conducting cord of claim 7 wherein the first and second cord identification members are inter-engageable only if the electricity conducting cord has a power rating the same as or higher than the apparatus power rating.

* * * * *